US005553472A

United States Patent [19]

Jasper

[11] Patent Number: 5,553,472

[45] Date of Patent: Sep. 10, 1996

[54] DRIVE APPARATUS AND PORTABLE POWER SOURCE FOR COMPUTERIZED COMBINATION LOCKS

[75] Inventor: Thomas E. Jasper, Bryantsville, Ky.

[73] Assignee: Lockmasters, Inc., Nicholasville, Ky.

[21] Appl. No.: 385,943

[22] Filed: Feb. 9, 1995

Related U.S. Application Data

[62] Division of Ser. No. 58,080, May 7, 1993, Pat. No. 5,493,882.

[51] Int. Cl.[6] ..... E05B 49/00

[52] U.S. Cl. ..... 70/278; 70/444; 70/329

[58] Field of Search ..... 70/442–446, 275, 70/277–279, 333 R, 303 R, 303 A, 332, 329

[56] References Cited

U.S. PATENT DOCUMENTS

| | | | |
|---|---|---|---|
| 874,438 | 12/1907 | Rautbord | 70/284 |
| 1,708,709 | 4/1929 | Tibbetts | 70/283 |
| 1,909,453 | 5/1933 | Brown | 70/284 |
| 2,078,168 | 4/1937 | Stone et al. | 70/285 |
| 2,575,674 | 11/1951 | Miller | 70/284 |
| 2,606,237 | 8/1952 | Chase | 70/278 |
| 2,879,657 | 3/1959 | Eichberg . | |
| 4,168,616 | 9/1979 | Goldman . | |
| 4,416,127 | 11/1983 | Naveda | 70/278 |
| 4,433,355 | 2/1984 | Chew et al. . | |
| 4,653,784 | 3/1987 | Lee | 292/DIG. 61 |
| 4,899,562 | 2/1990 | Gartner et al. | 70/332 |
| 4,901,545 | 2/1990 | Bacon et al. | 70/285 |
| 4,904,984 | 2/1990 | Gartner et al. | 70/333 R |
| 4,912,460 | 3/1990 | Chu . | |
| 4,922,736 | 5/1990 | Tanaka et al. | 70/408 |
| 4,998,760 | 3/1991 | Nixon et al. | 292/DIG. 61 |
| 5,061,923 | 10/1991 | Miller et al. | 70/278 |
| 5,184,491 | 2/1993 | Schittenhelm | 70/278 |
| 5,265,452 | 11/1993 | Dawson et al. | 70/277 |

FOREIGN PATENT DOCUMENTS

| | | | |
|---|---|---|---|
| 0519755A1 | 6/1992 | European Pat. Off. . | |
| 2136269 | 12/1972 | France . | |
| 32088180A1 | 9/1983 | Germany . | |
| 4-11179 | 1/1992 | Japan . | |
| 1582518 | 1/1981 | United Kingdom | 70/275 |
| WO80/02710 | 12/1980 | WIPO . | |

OTHER PUBLICATIONS

Locksmith Ledge International, "X–07: A Safe Lock That Operates Electronically", 51 (1991) Jul. No. 9, pp. 150 and 151.

*Primary Examiner*—Darnell M. Boucher
*Attorney, Agent, or Firm*—Lowe, Price, LeBlanc & Becker

[57] ABSTRACT

A drive apparatus for use with a computerized combination dial lock includes a rotating or longitudinally translating member which imparts motion to an electrical generator for powering the electrical components of the computerized combination dial lock. The drive apparatus is independent of the combination dial of the computerized lock. In one embodiment, the dial ring of the combination dial is rotatable to drive the electrical generation for power output to the computerized lock components. Alternatively, the combination dial and spindle are spring biased for longitudinal translation thereof to drive the electrical generator. In another embodiment, a lever member adjacent the dial ring or a key inserted in a keyway is rotated for powering the computerized lock. In yet another embodiment, a portable power source is in the form of a key and a portable power source contained therein. The key is designed to engage a keyway mounted in or adjacent the combination dial lock assembly to provide power to the electrical components therein. The power source can include a battery or solar power, or be developed by mechanical energy.

5 Claims, 7 Drawing Sheets

DRIVE APPARATUS AND PORTABLE POWER SOURCE FOR COMPUTERIZED COMBINATION LOCKS

This application is a division of application Ser. No. 08/058,080 filed May 7, 1993, now U.S. Pat. No. 5,493,882.

FIELD OF THE INVENTION

The present invention is directed to a manually driven electricity generator for powering electronically controlled combination locks.

BACKGROUND ART

It has been proposed to substitute, for conventional mechanical door locks, systems of various sorts in which a physical or code-generated "key" is recognized by an electronic circuit which enables a locking bolt to be withdrawn. However, these types of electronic locks require a battery or other power source, such as a solar cell, to be incorporated in the lock housing. Failure to change the lock battery or inadequate ambient lighting makes it impossible to reliably operate conventional electronic locks.

Attempts have been made to utilize in-the-door power generation to eliminate the need for an external power source in electronic locks. PCT International Publication No. WO 80/02710 shows the use of an in-the-door electrical generator to power electronic decision makers to move bolts or gates which allow latches to be moved.

U.S. Pat. No. 4,433,355 to Chew et al. discloses an electronic lock for a door including a built-in generator for generating electrical energy to operate an electronic code recognition circuit. The generator is linked to a door handle spindle.

U.S. Pat. No. 4,912,460 to Chu discloses an electromechanical gating mechanism including electrical energy generating means which generates electrical energy in response to and utilizing energy derived from mechanical motion continuously generated by an individual pushing a key into a lock or operating a series of buttons or touch pad areas which produce energy piezoelectrically.

SUMMARY OF THE INVENTION

A computerized combination lock, in accordance with the invention, comprises a dial and dial ring assembly mounted on a face of the security container, an electrical generator, a drive apparatus for imparting motion to the electrical generator, and a microprocessor and lock assembly arranged within said container to be secured and powered by the electrical generator for operation of the computerized combination lock. The dial ring is rotatably mounted on the face of the container for limited rotational movement and the drive apparatus further comprises means for transmitting the rotational movement of the dial ring to the electrical generator for powering the microprocessor and lock assembly.

The dial ring can directly engage the electrical generator when the electrical generator is mounted adjacent the dial ring and outside of the security container. Alternatively, the electrical generator can be mounted within the security container wherein a spindle interconnects the dial ring and electrical generator to transmit rotational movement thereto.

In another embodiment, the dial and dial ring assembly includes a lever member, rotation of which drives the electrical generator for powering the microprocessor and lock assembly. The lever member may engage the electrical generator when mounted adjacent the dial ring or may be linked to the electrical generator via a spindle extending through the security container.

In a further embodiment of the inventive drive apparatus, a dial ring and guide bushing assembly permits axial translation of the dial ring to power an electrical generator mounted within the security container. A guide bushing acts as a stop to limit axial and outward translation of the dial ring from an exterior face of the security container.

Another embodiment of the inventive drive apparatus includes a key having an elongated portion and a keyway arranged externally of the security container and sized to receive the key and permit rotation thereof. The drive apparatus includes means for transmitting rotation of the key to an electrical generator for powering the microprocessor and lock assembly and computerized combination lock. The key may be removably insertable in the keyway or integrally attached to the means for transmitting rotation to the electrical generator. In either case, rotation of the key powers the electrical generator.

The present invention also provides a portable source of electric power, preferably in the form a key. The key is inserted into a keyway located on the security container. Insertion of the key into the keyway connects the portable source of electric power contained in the key to the microprocessor and lock assembly within the security container for computerized lock operation.

BRIEF DESCRIPTION OF DRAWINGS

Reference is now made to the drawings accompanying the invention wherein:

FIGS. 7 and 7*a* are a perspective view and a side view, respectively, of a fifth embodiment of the present invention;

DETAILED DESCRIPTION OF THE INVENTION

Figure 1:
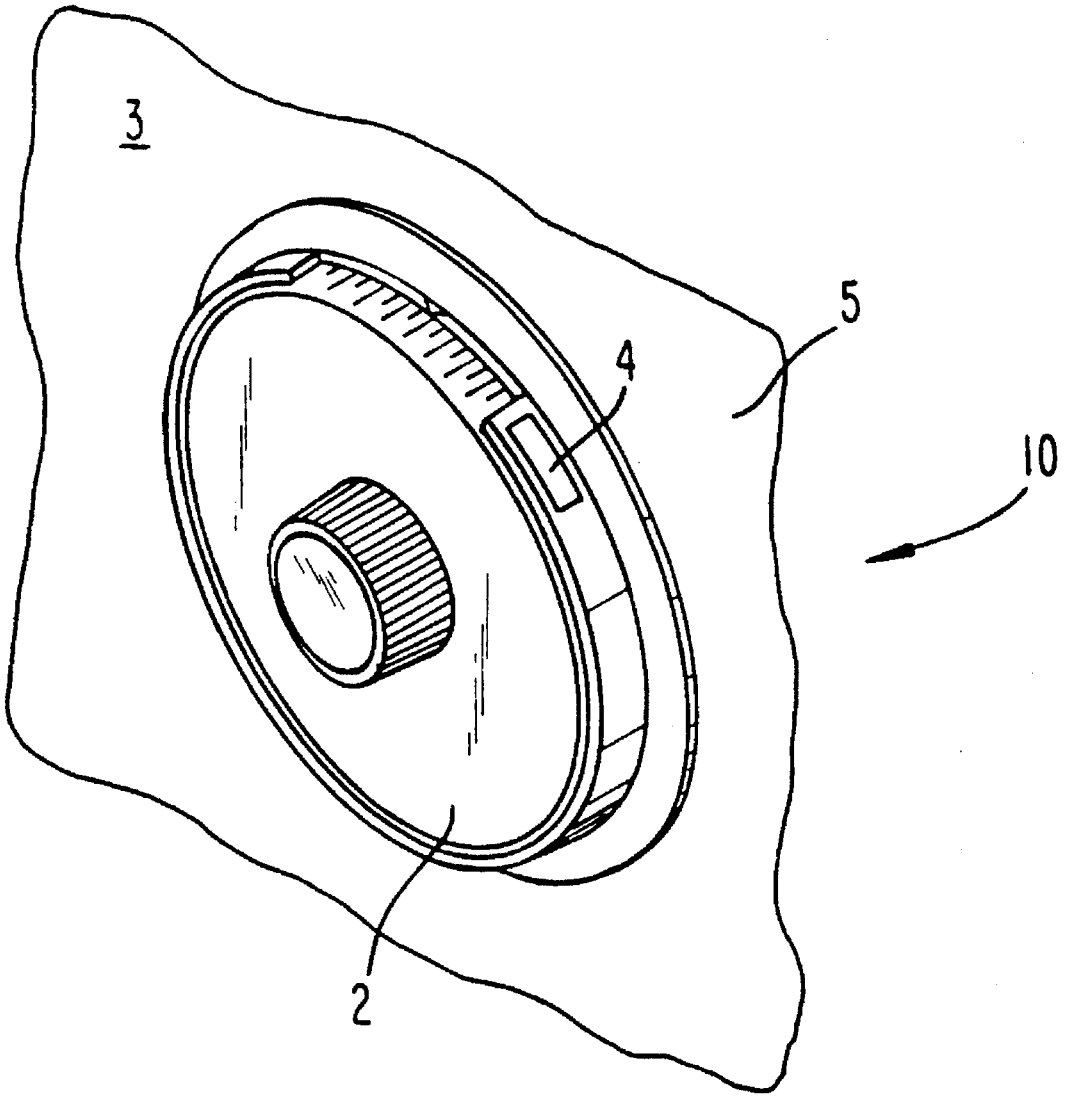
FIG. 1 is a perspective view of a first embodiment according to the present invention.
Figure 2:
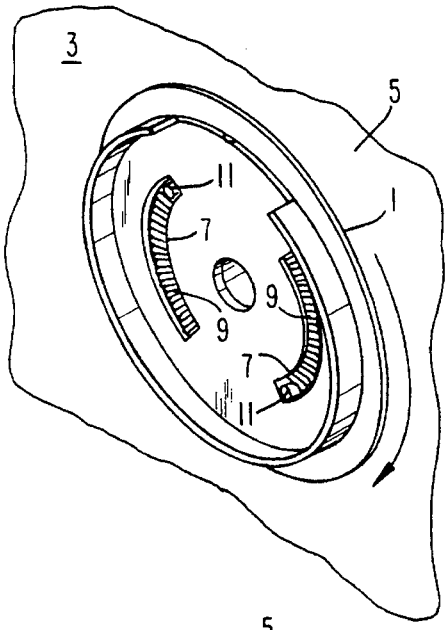
FIG. 2 is a perspective view of the embodiment of FIG. 1 with the dial removed.

Reference is now made to FIGS. 1 and 2 wherein a first embodiment of the drive apparatus is generally designated by the reference numeral 10 and is seen to include a rotatable dial ring 1 mounted on the face 3 of a security container wall 5, a combination dial 2 and display 4. The combination dial 2 rotates independently of the dial ring. The dial ring 1 has a pair of arcuately-shaped and diametrically opposed openings 7 as shown in FIG. 2. Arranged in each of the openings 7 are springs 9 and stops 11 which control rotation and biasing of the dial ring during operation.

Figure 3:
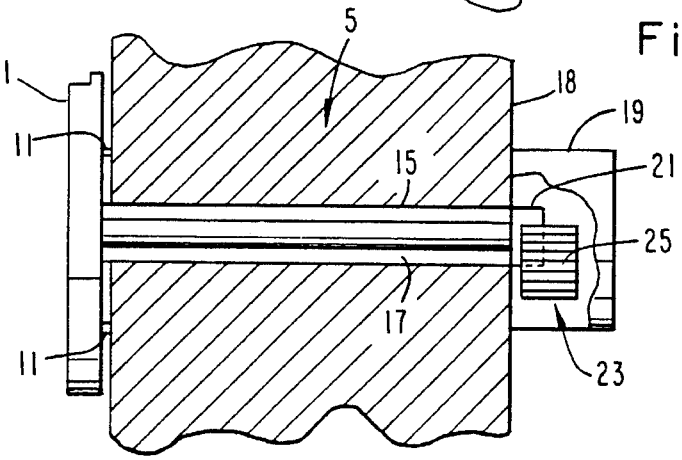
FIG. 3 is a side view of the embodiment depicted in FIG. 2.

Dial ring 1 includes an outer spindle 15, as shown in FIG. 3. Arranged on the inside surface 18 of the security container wall 5 is a lock casing 19. The lock casing 19 encloses the distal end 21 of the outer spindle 15 and an electrical generator 23. The distal end 21 is geared to engage the gear portion 25 of the electrical generator 23.

In operation, the dial ring 1 is rotated clockwise such that springs 9 are fully compressed within the openings 7. The limited rotation of the dial ring 1 rotates the generator 23 to power the microprocessor and lock assembly (not shown) of a computerized lock assembly.

It should be understood that the electrical generator 23 is analogous to the type of electrical generating means disclosed in U.S. Pat. No. 5,061,923 to Miller et al., hereby incorporated by reference in its entirety. Repeated rotation of the dial ring operates the electrical generator to supply electrical power to the microprocessor and lock assembly components and circuitry of the computerized combination lock. It should be understood that the microprocessor and lock assembly refers to all components and wiring necessary for computerized combination lock operation once power is supplied by the electrical generator or other power source. For example, all the components powered by the stepper motor/generator of the Miller et al. patent including the dead bolt drive means constitute a microprocessor and lock assembly. Of course, other known electronic combination dial locks may be used with the present invention.

The inner spindle 17 is attached to a combination dial (not shown) at one end thereof. The other end of the inner spindle 17 drives the appropriate gear or other device on an encoder to generate a code sequence for combination lock operation. Any shaft rotation encoder, such as is described in the aforementioned Miller et al. patent, is applicable.

The stops 11 act to limit rotation of the dial ring. The springs 9 provide a biasing force in a counter-clockwise direction. This biasing force facilitates repeated and limited rotation of the dial ring by urging the dial ring in a counter-clockwise direction.

Figure 4:
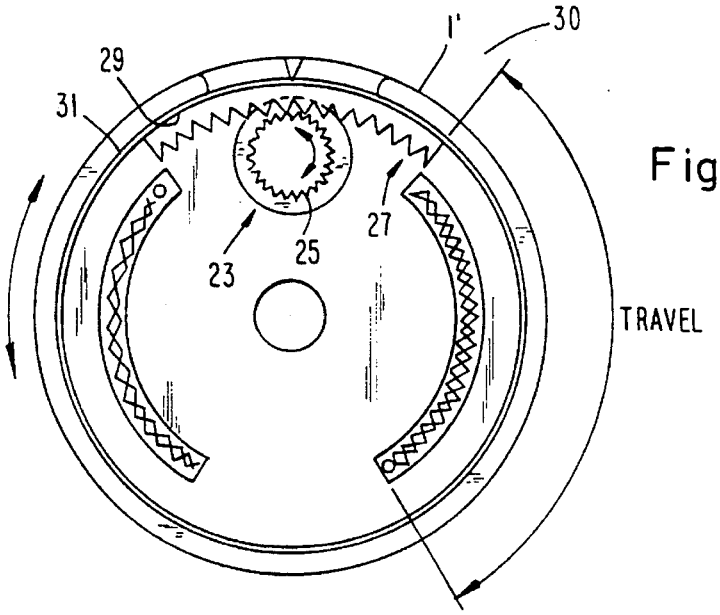
FIG. 4 is a front view of a second embodiment of the drive apparatus of the present invention.

With reference to FIG. 4, an alternative embodiment using the dial ring to power the generator is generally designated as reference numeral 30 and is seen to include dial ring 1'. In this embodiment, the dial ring 1' includes a geared portion 27 arranged along an inner face 29 of the flange 31. The geared portion 27 engages the geared portion 25 of the electric generator 23 to power the microprocessor and lock assembly.

In operation, clockwise rotation of the dial ring 1' cause the rotation of the electrical generator through mutual engagement of the gear portion 25 of the generator 23 and the geared portion 27 of the dial ring 1'. In this embodiment, the electrical generator 23 is associated with the dial ring 1' rather than the inner surface 17 and lock casing 19 of the security container wall 5 as shown in FIG. 3.

Figure 5:
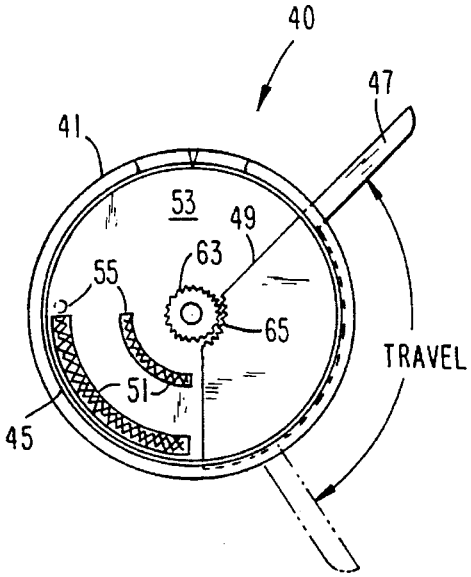
FIGS. 5 and 5*a* are front and side views, respectively, of a third embodiment of the drive apparatus of the present invention.
Figure 5A:
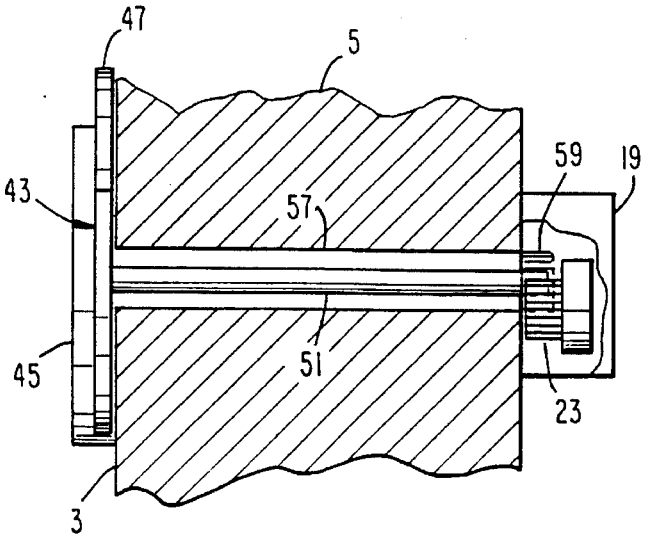

A third embodiment of the drive apparatus of the present invention is depicted in FIGS. 5 and 5*a* and is generally designated by the reference numeral 40. In this embodiment, a dial ring 41 is rigidly attached to the surface 3 of the security container wall 5. The dial ring includes a slot 43 in the peripheral flange 45. Extending through the slot 43 is a rotatably mounted lever member 47.

The lever member 47 functions in a similar manner to the rotating dial ring 1 of FIG. 2. That is, the arcuate portion 49 of the lever member 47 engages a pair of springs 51 for biasing the lever member 47 against clockwise rotation. Although not shown, the springs 51 may be secured to the dial ring 41 in any known fashion to provide a limited travel of lever number 47 as depicted by the arrow. For example, stops, retaining walls or other means may be provided to secure the springs in place.

The dial ring 41 includes an outer spindle 57 similar to the spindle 15 depicted in FIG. 3 of the first embodiment of the invention. The outer spindle 57 includes a geared distal end 59 designed to rotate the generator 23 in the lock casing 19. An inner spindle 61 facilitates generation of a code sequence through combination dial rotation, as described above.

The outer spindle 57 has a geared end 63 which engages the arcuate geared portion 65 of the lever member 47. This engagement translates clockwise rotation of the lever member 47 to rotation of the spindle 57 so as to engage and rotate the electrical generator 23.

In this embodiment, the lever 47 is repeatedly cranked or rotated clockwise to drive the electrical generator 23 and power the microprocessor and lock assembly for computerized lock operation.

Figure 6:
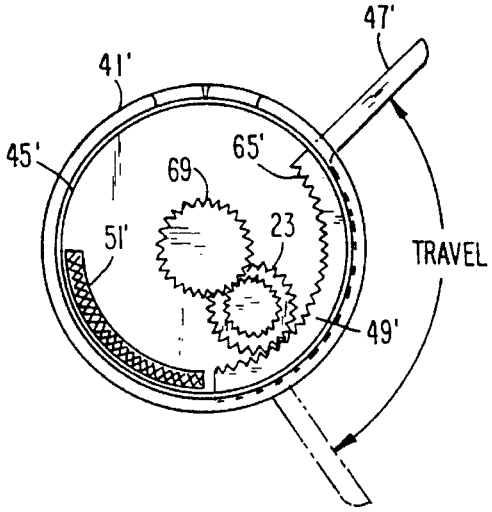
FIGS. 6 and 6*a* are front and side views, respectively, of a fourth embodiment of the present invention.
Figure 6A:
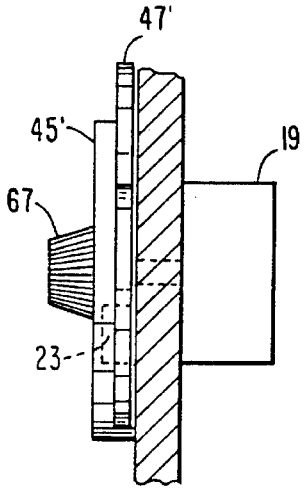

FIGS. 6 and 6*a* show an alternative embodiment of the dial ring and lever arrangement depicted in FIGS. 5 and 5*a*. In this embodiment, the electrical generator 23 is arranged adjacent the dial ring 41'. The lever 47' includes a gear portion 65' designed to engage the electrical generator located inwardly of the peripheral flange 45'.

In this arrangement, a single spring 51' is aligned with the arcuate portion 49' of the lever member 47' to achieve the biasing force as described above.

To provide signal pulses to generate a code sequence, the combination dial includes a gear portion 69 to engage the electrical generator 23 for code sequence generation.

It should be understood that the embodiment depicted in FIGS. 6 and 6*a* use the same limited clockwise rotation as described for the lever assembly 47 shown in FIGS. 5 and 5*a*.

Figure 7A:
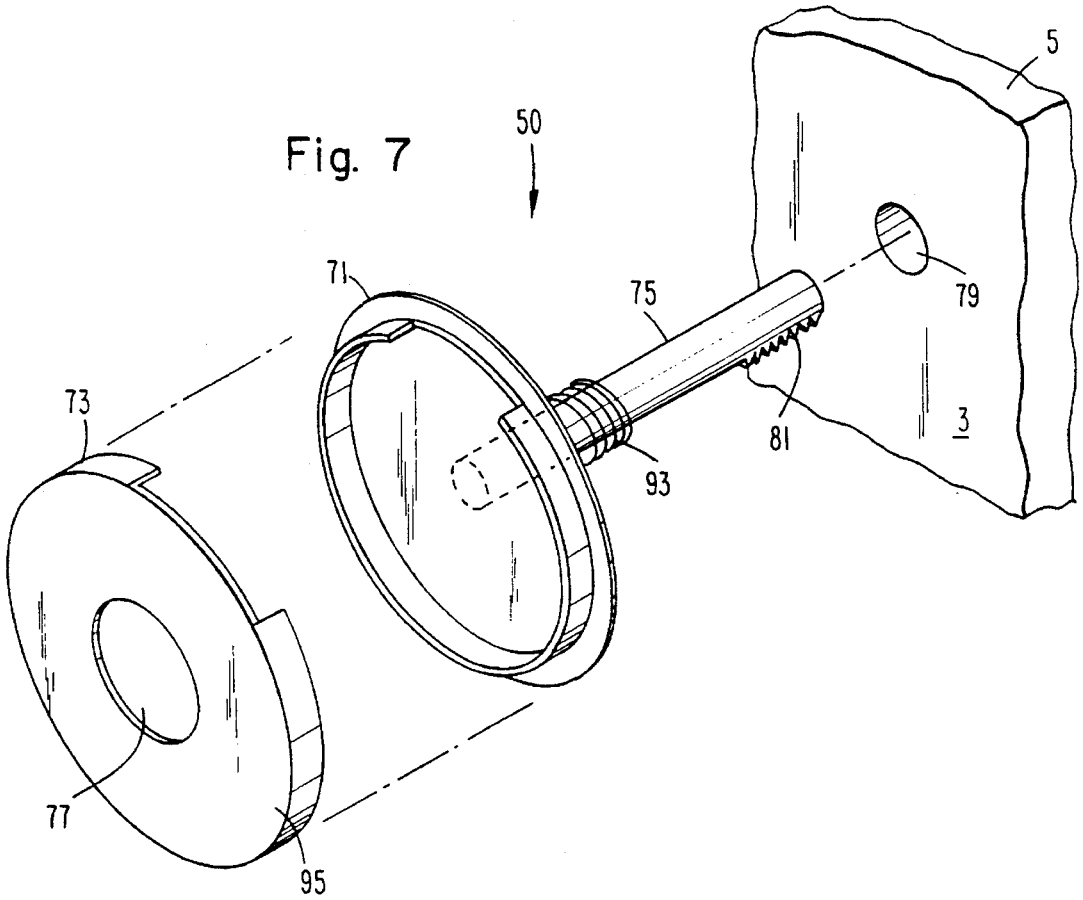
Figure 7A:
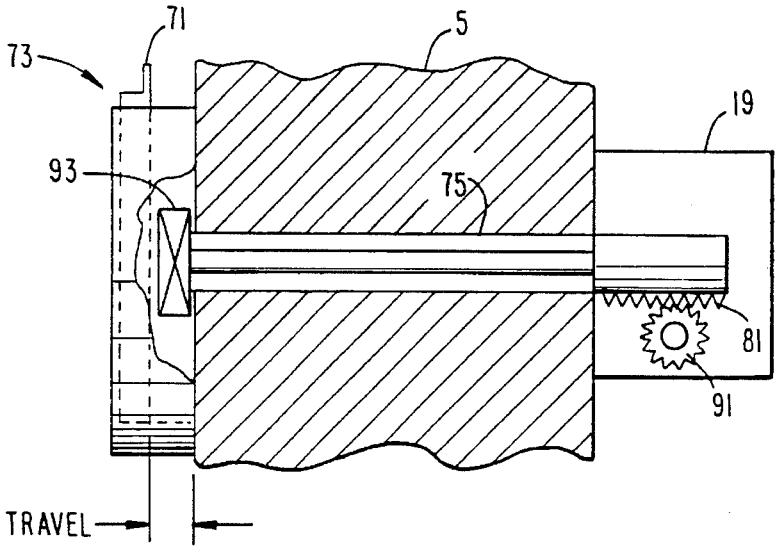

FIGS. 7 and 7*a* depict an embodiment of the drive apparatus which uses longitudinal translation rather than rotative movement to power the electrical generator. In this embodiment, generally designated by the reference numeral 50, an exploded view is depicted showing the dial ring 71, guide bushing 73, and outer spindle 75 extending from the back of the dial ring 71. The guide bushing 73 includes an opening 77 to receive the dial knob of a combination dial (not shown). The outer spindle 75 extends through the opening 79 in the security container wall 5. The distal end of the outer spindle includes a rack 81 which engages a pinion gear 91. The spindle 75 also has a spring 93 therearound and arranged between the face 3 of the security container wall 5 and the back of the dial ring 71. The spring 93 biases the dial ring outwardly and against the end face 95 of the guide bushing 73.

In operation, an operator repeatedly depresses the dial knob of a combination dial which in turn longitudinally translates the dial ring 71 and rack 81 to rotate the pinion gear 91. The pinion gear 91 is part of the electrical generator such that repeated longitudinal translation of the dial ring 71 powers the electrical generator for computerized lock operation.

The guide bushing 73 is mounted to the surface 3 to limit the outward extension of the dial ring 71 as a result of the force exerted by the spring 93.

Although the drive apparatus of the several embodiments discussed above provides generation of electrical power through clockwise rotation of a dial ring or lever member, electrical circuitry such as a diode bridge may be utilized to generate power both through clockwise and counter-clockwise travel of the drive apparatus.

Moreover, the biasing means which facilitate repeated cranking or rotation of the appropriate component are optional since repeated clockwise and counter-clockwise movement can also be performed manually and without benefit of spring biasing. If biasing is utilized, any conventional means to obtain the biasing forces described above may be utilized in conjunction with the inventive drive apparatus.

The electrical generator described above may be any type capable of generating sufficient electrical power to operate the electronic circuitry of the computerized lock assembly. The generator disclosed in the Miller et al. patent or its equivalent is a preferred type but any other known type may also be utilized with the inventive drive apparatus.

Figure 9:
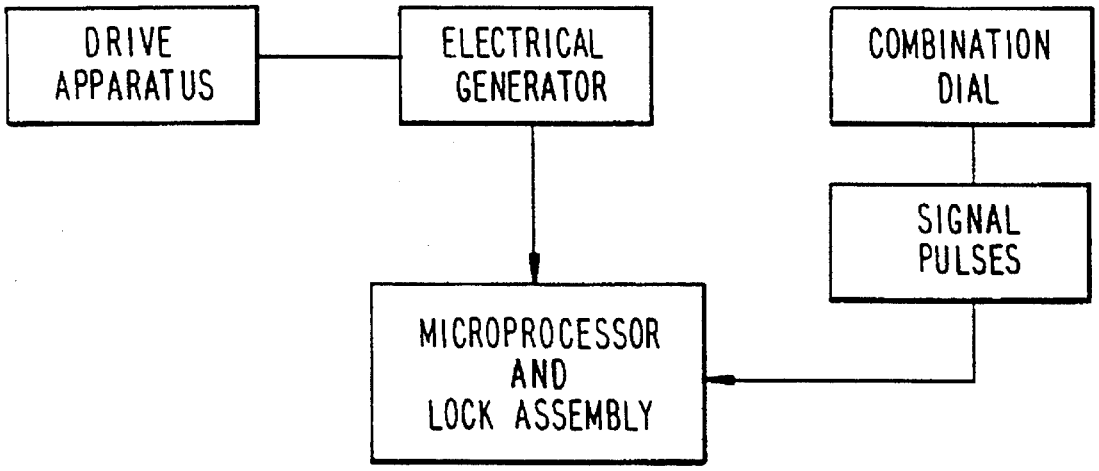
FIG. 9 is a schematic diagram illustrating the inventive drive apparatus and a computerized lock assembly with the electronic circuit shown in block form.

FIG. 9 is a schematic diagram showing the drive apparatus separately powering the electrical generator which in turn powers the microprocessor and lock assembly. The combination dial is separate from the drive apparatus and provides the signal pulses for processing by the microprocessor of the microprocessor and lock assembly for combination dialing detection.

Figure 8:
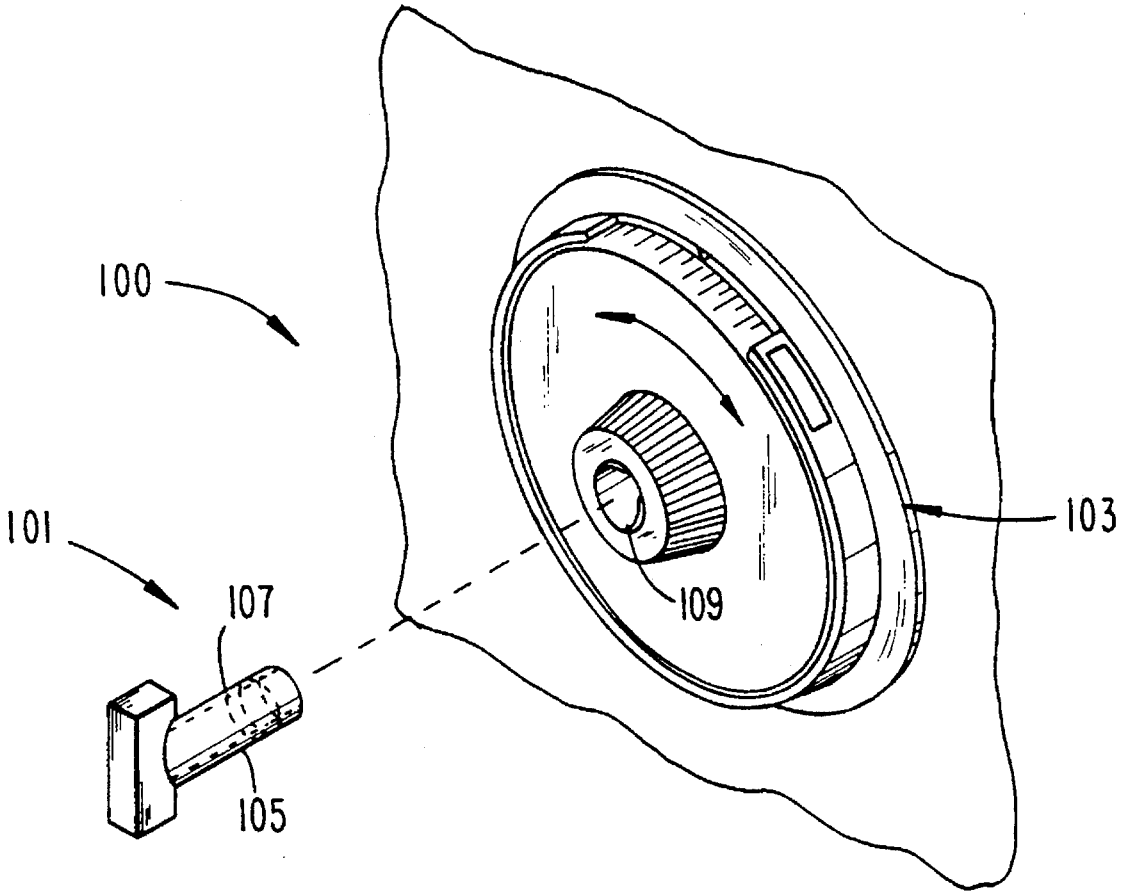
FIG. 8 is a perspective view of a portable power source for driving a computerized combination lock according to the invention.

In another aspect of the invention, a portable power source is provided in combination with a computerized lock assembly. The portable power source eliminates the need for a drive apparatus and electrical generator to power the various microprocessor and lock assembly components. With reference now to FIG. 8, a portable power source and computerized lock assembly is generally designated by the reference numeral 100 and seen to include a portable power source 101 and a computerized combination lock 103. The portable power source 101 is depicted in key form with a battery 105 housed within the elongated portion 107 of the key body. The computerized combination dial lock assembly 103 includes a keyway 109 designed to receive the elongated portion 107.

The battery 105 mounted within the elongated portion 107 provides power by the appropriate electrical connections to the microprocessor and lock assembly of the computerized combination dial lock 103. In operation, inserting the portable power source 101 into the keyway 109 powers the computerized combination dial for lock operation directly, or charges a capacitor that powers the operation.

Figure 10:
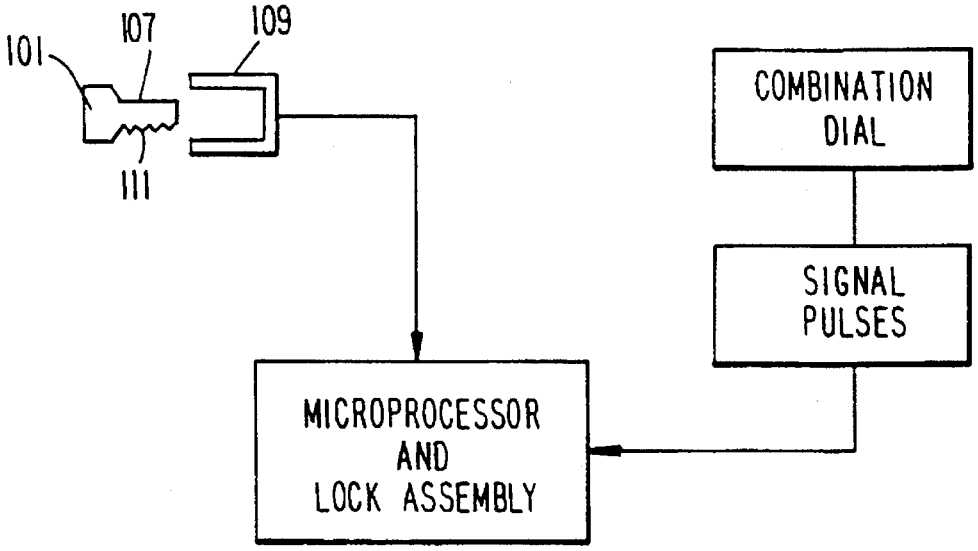
FIG. 10 is a schematic diagram of the embodiment depicted in FIG. 8 illustrating the computerized lock assembly with the electronic circuit shown in block form.

FIG. 10 more clearly illustrates the portable power source 101 engaging the keyway 109 to power the microprocessor and lock assembly. Again, and in this embodiment, the combination dial providing signal pulses to the microprocessor is separate from the portable power source 101 and keyway 109.

Although a key-shaped portable power source and self contained battery are illustrated, other portable power sources may be utilized for powering the computerized combination dial lock assembly 103. For example, the portable power source 101 may include a self winding generator such as those found in watches. Alternatively, the portable power source may include a solar cell on an exterior surface thereof as the power source. The portable power source 101 may include a generator, which derives power by a length of wire or rope which is self-contained in the portable power source and attached to key 107. The generator contained within the power source body is operated by pulling on the length of wire or rope followed by insertion of the key 107, which transfers power from the generator to the keyway to power the combination dial lock. In this embodiment, the wire or rope is retracted into the power source when not in use. The rope or wire may also be used to transmit power from the generator to the key and computerized combination dial lock.

The elongated portion 107 may be keyed as designated by the numeral 150 to provide further security when powering the computerized combination dial lock. In this embodiment, the keyway 109 would correspond to a key lock. Using the correct key 150 would permit rotation of the portable power source 101 in the keyway 109. Upon completion of the rotation, the portable power source in the key 101 would power the computerized combination dial lock for operation. In this manner, only the portable power source having the proper key portion 150 could be used to operate the computerized combination dial lock.

Figure 11:
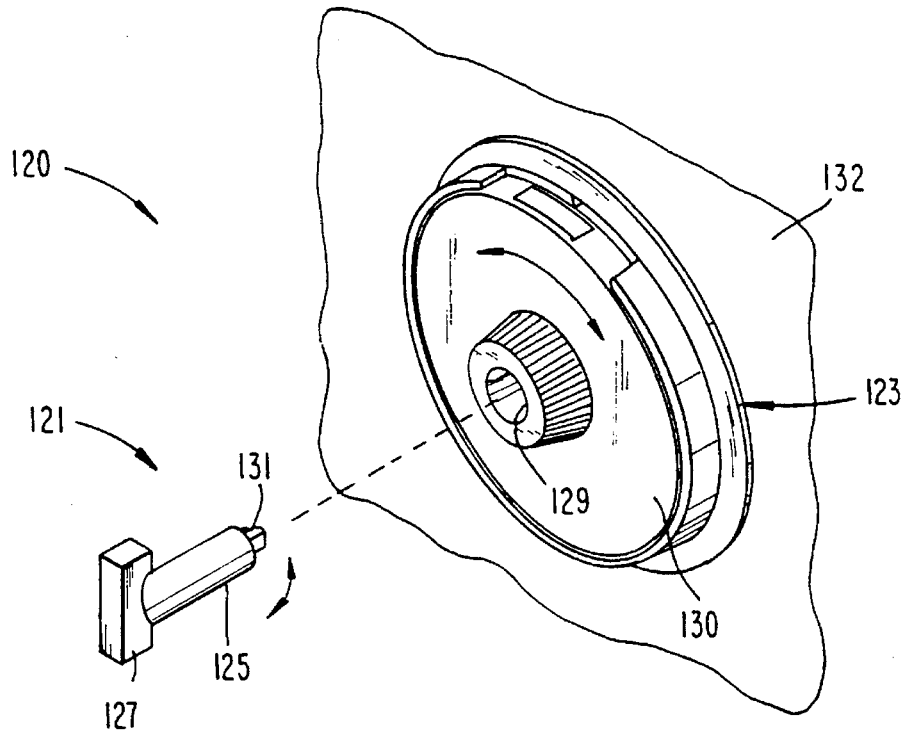
FIG. 11 is perspective view of a sixth embodiment of the present invention.
Figure 12:
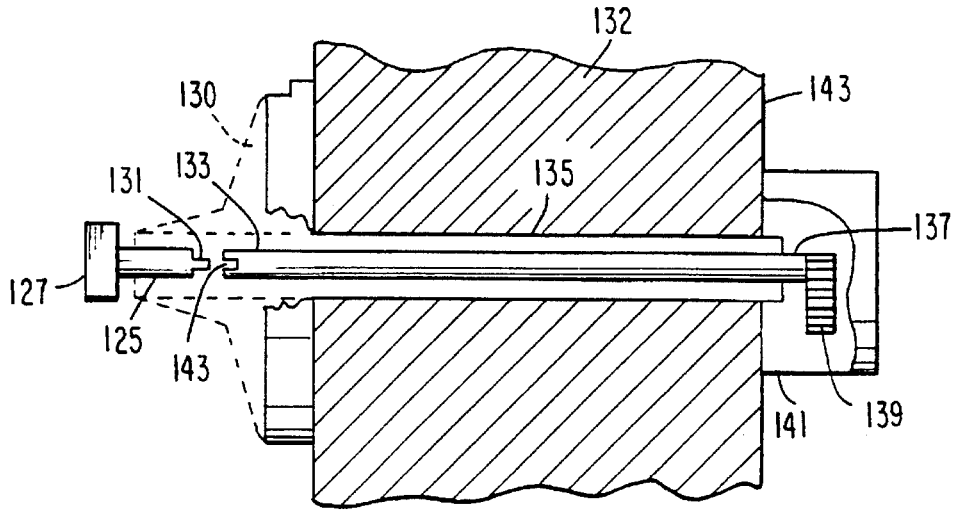
FIG. 12 is a side view of the embodiment FIG. 11 with the dial shown in phantom.

With reference now to FIGS. 11 and 12, an alternative drive apparatus for powering a computerized combination lock is generally designated by the reference numeral 120 and seen to include a key 121 and a computerized combination lock 123. The key has an elongated portion 125 extending from a key body 127. The distal end of the elongated portion 125 includes a lug 131 which assists in powering the computerized combination lock as will be described hereinafter.

The computerized combination lock has a keyway 129 sized to receive the elongated portion 125. It should be understood that, although the keyway is depicted axially aligned with the combination dial 130, the keyway may be arranged elsewhere on the security container 132.

With reference to FIG. 12, a side view of the inventive drive apparatus is depicted with portions broken away and the combination dial in phantom to show greater detail. Extending through the security container 132 is an inner spindle 133 co-axially aligned with an outer spindle, a portion of which shown as 135, of the combination dial 130. The outer spindle 135 functions in the same manner as described above for the embodiment depicted in FIGS. 1–3.

The inner spindle 133 functions in a similar manner as the outer spindle 15 depicted in FIG. 3. That is, a distal end of the inner spindle 133 has a geared portion 137 designed to engage the electrical generator 139 mounted within the lock casing 141. The lock casing is shown adjacent the security container inner surface 143.

On the opposite end of the inner spindle is a recess 143 sized to receive the lug 131 of the key 121. Both the recess 143 and lug 131 are shaped to avoid slippage therebetween and permit transmission of the rotation of the key 121 to the inner spindle 133 and electrical generator 139. For example, octagonal or hexagonal shapes may be used. When the key 121 is removably connectable to the inner spindle 133, any known removable connecting means may be utilized for engagement therebetween.

In operation, the key body 127 is rotated as shown by the arrows in FIG. 11 to rotate the inner spindle 133 and impart rotative motion to the electrical generator 139 to power the computerized combination lock 123. As described above, the rotation may be clockwise or counter clockwise depending on the particular electrical generator selected. Moreover, the inner spindle may be designed for limited rotational movement as exemplified by the embodiments depicted in FIGS. 2 and 4–6. In this mode, stops on the exterior surface of the inner spindle can engage springs, travel of which being limited by further stops mounted on an adjacent structure. Thus, the keybody 127 could be rotated in repeated and limited intervals to drive the electrical generator and power the computerized combination lock.

In yet another embodiment, the key 121 may be integrally attached to the inner spindle 133. In this embodiment, the inner spindle 133 would extend from the electrical generator 139 to the keybody 127 or other turning knob to permit rotation of the inner spindle and electrical generator.

Accordingly, an invention has been disclosed in terms of preferred embodiments thereof which fulfill each and every one of the objects of the present invention as set forth hereinabove and provides a new and improved portable power source and drive apparatus for computerized combination dial locks.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A computerized combination lock for a security container comprising:

a) a combination dial and a dial ring mounted on a face of said security container;

b) an electrical generator;

c) a drive apparatus for imparting motion to said electrical generator;

d) a microprocessor and lock assembly arranged within said security container and being powered by said electrical generator for operation of said computerized combination lock;

e) wherein said dial ring is rotatably mounted to said face of said security container for rotational movement, said combination dial being rotatable independently of said dial ring; and f) said drive apparatus further comprises an element coupling said rotational movement of said dial ring to said electrical generator for powering said microprocessor and lock assembly, wherein said electrical generator is mounted adjacent of a flange of said dial ring and said flange includes a geared portion for transmitting said rotational movement imparted to said dial ring to said electrical generator by engagement with said electrical generator.

2. The computerized combination lock of claim 1 wherein said dial ring is rotatably mounted for limited rotational movement and said drive apparatus includes means for biasing said dial ring in a direction opposite said limited rotational movement.

3. The computerized combination lock of claim 2 wherein said biasing means comprises at least one spring arranged in an arcuate slot in said dial ring.

4. The computerized combination lock of claim 2 wherein said dial ring has at least one arcuate slot therein and said face includes at least one stop extending outwardly therefrom and positioned within said slot to limit said rotational movement of said dial ring.

5. The computerized combination lock of claim 4 wherein said dial ring has a pair of diametrically opposed arcuate slots.

* * * * *